United States Patent [19]

Ebihara et al.

[11] Patent Number: 4,836,820

[45] Date of Patent: Jun. 6, 1989

[54] MOVING ANIMAL TOY

[75] Inventors: Satoru Ebihara; Jiro Yamaguchi, both of Tokyo, Japan

[73] Assignee: Iwaya Corporation, Tokyo, Japan

[21] Appl. No.: 182,304

[22] Filed: Apr. 15, 1988

[30] Foreign Application Priority Data

Oct. 20, 1987 [JP] Japan ..... 62-265061

[51] Int. Cl.[4] ..... A63H 11/12; A63H 13/04

[52] U.S. Cl. ..... 446/289; 446/288; 446/354

[58] Field of Search ..... 446/279, 280, 286, 288, 446/289, 290, 291, 292, 269, 354, 353

[56] References Cited

U.S. PATENT DOCUMENTS

| | | | |
|---|---|---|---|
| 1,477,412 | 12/1923 | Adams | 446/354 |
| 2,248,214 | 7/1941 | Bleeker | 446/288 |
| 2,566,141 | 8/1951 | Poli | 446/288 |
| 4,305,222 | 12/1981 | Terzian et al. | 446/288 |
| 4,422,261 | 12/1983 | Kozuka et al. | 446/290 |
| 4,708,688 | 11/1987 | Lee | 446/288 |

FOREIGN PATENT DOCUMENTS

| | | | |
|---|---|---|---|
| 66949 | 12/1950 | Netherlands | 446/279 |
| 20759 | 5/1903 | United Kingdom | 446/286 |

*Primary Examiner*—Mickey Yu
*Attorney, Agent, or Firm*—James E. Nilles

[57] ABSTRACT

A moving animal toy consisting of a ski member having a guide slot at the center thereof, a toy member erected on the ski member and having right and left arms holding poles, and a wheel rotatably supported by the toy member and partially projected from the bottom of the ski through the guide slot, wherein as the wheel is turned, the toy member slides resting on the ski member, and the right and left arms alternately oscillate vertically to raise and lower the right and left poles alternately, performing slalom.

6 Claims, 4 Drawing Sheets

MOVING ANIMAL TOY

BACKGROUND OF THE INVENTION

1. Field of the Invention

The present invention relates to a moving animal toy and more particularly to a moving toy that acts as if it were skiing.

2. Description of the Prior Art

Various types of moving aminal toys have been manufactured. Most of these animal toys perform actions by moving their own hands, legs or head or play musical instruments.

The conventional moving animal toys amuse the user by their own motions or actions and there are no such toys as perform skiing by riding on skis.

SUMMARY OF THE INVENTION

The object of this invention is to provide a moving animal toy which rides on skis manipulating its poles and performs slalom by edging the skis on turns.

The moving animal toy according to this invention consists of: a ski member having an arc-shaped sliding surface and a guide slot at the center of the sliding surface; a toy member erected on the ski member at the guide slot, the toy member having right and left arms holding poles, the arms being vertically oscillatable; a wheel rotatably supported at the lower portion of the toy member, the wheel being partially projecting from the sliding surface through the guide slot; a first cam plate and a second cam plate, both rotably supported on the toy member, to alternately oscillate the right and left arms vertically; and an output mechanism installed in the toy member to rotate the first and second cam plates and rotate the wheel through a gear mechanism.

In the moving animal toy according to this invention, as the output mechanism is activated, the wheel is turned through the gear mechanism and the first and second cam plates are also rotated.

Then as the wheel is turned, the toy member slides resting on the ski member, and at the same time, the rotation of the first and second cam plates causes the right and left arms to alternately oscillate vertically to raise and lower the right and left poles alternately, performing slalom. In more detail, the first and the second cam plates are 90° out of phase and when these cam plates are rotated together with the wheel, the right and left arms are alternately oscillated vertically and intermittently, causing the poles attached to the arms on each side to alternately move up and down.

When, for example, with the end of the right-hand pole in contact with the floor and the end of the left-hand pole lifted from the floor, the right arm is oscillated upward and the left arm downward, the toy member shifts its center of gravity to the right with respect to the moving direction with the wheel acting as the pivot center as shown in FIG. 2. The toy member tilts toward the right arm which was raised and is supported by the pole on the right whose end contacts the floor.

At this time, the wheel is rotating, so that as the toy member tilts toward the right with respect to the moving direction together with the wheel and the ski member, the right-inclined ski member slides describing a curved trail toward the right.

Further, when the right arm which was raised is oscillated downward and the left arm upward, the toy member tilts toward the left arm which is being raised and is supported by the pole attached to the left arm.

The rotation of the wheel and the sliding of the left-inclined ski member cause the toy member to slide describing a curved trail toward the left.

Therefore, by the alternate and vertical oscillation of its right and left arms the toy member acts like a skier performing slalom making serpentine turns by using poles.

These and other objects and features will be described by referring to the attached drawings.

BRIEF DESCRIPTION OF THE DRAWINGS

The attached drawings represent one embodiment of this invention, in which.

DESCRIPTION OF THE PREFERRED EMBODIMENT

Figure 1:
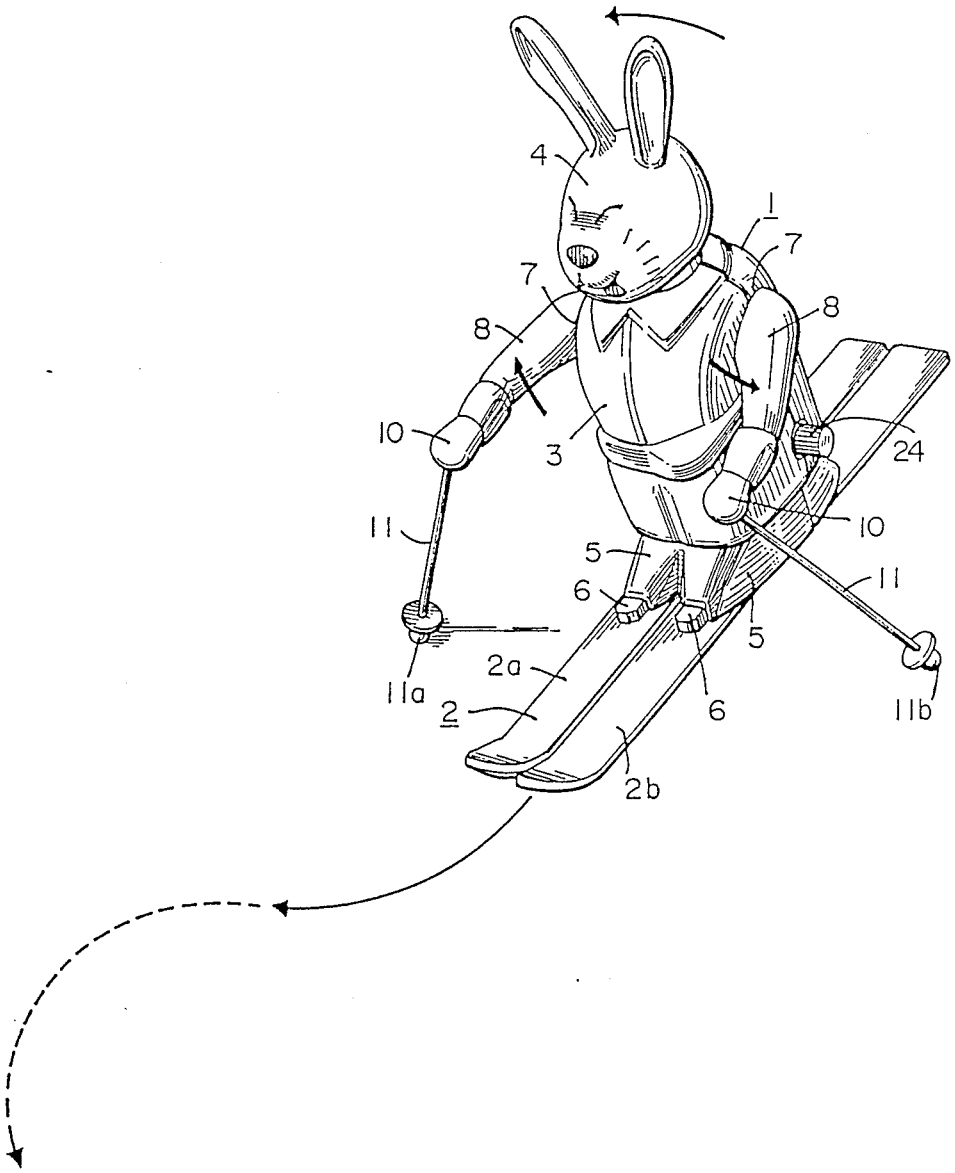
FIG. 1 is a perspective view of the moving animal toy.

In the drawings, reference numeral 1 represents a toy member formed in the likeness of a rabbit which is securely mounted on a ski member 2.

The toy member 1 has a body 3 which can be divided in the front and rear halves. A head 4 is removably mounted on the top of the body 3. At its lower part the body 3 has legs 5, 5 on each side which serve also as ski boots. The front and rear parts of the legs 5, 5 are removably secured to engagement projections 6, 6 which are formed to resemble of front and rear bindings or buckles. At right and left shoulders the body 3 has guide holes 7 in which mounting shafts 9, 9 of right and left arms 8, 8 are rotatably inserted. The arms 8, 8 have hands 10, 10 to which the upper ends of poles 11, 11 are vertically secured.

The body 3 has a fixed frame 12 therein. At the lower front and rear ends the frame 12 has engagement projections 13, 13 that engage with stoppers 14, 14 that project from the ski member 2. At an upper part on each side the frame 12 has horizontally projecting support shafts 15, 15 which are rotatably inserted in the mounting shafts 9, 9 of the arms 8, 8, so that the right and left arms 8, 8 are vertically rotatable.

Rigidly installed in the frame 12 is a gear case 16 that has an output shaft 17 rotatably supported horizontally at a power output mechanism comprising a lower part thereof. At an intermediate portion of the output shaft 17 is mounted a wound spring 18 which is secured to the output shaft 17 through its inner end engagement portion 19. The outer end engagement portion 20 of the spring 18 wound on the output shaft 17 is connected to an engagement portion of the gear case 16. The output shaft 17 has an output gear 21 securely mounted at an intermediate portion. At each end the output shaft 17 has a first cam plate 22 and a second cam plate 23 secured thereto. The output shaft 17 also has a thumb wheel 24 projecting from one side of the body 3, the thumb wheel 24 having seration at one end to prevent slippage. The first cam plate 22 has a moderately curved cam 25 on upper and lower parts of the periphery with respect to the output shaft 17 as a center. At the front and rear ends of the cam plate 22 with respect to the output shaft 17 as a center, push sections 26 are formed continuously with the cam 25. The first cam plate 22 as a whole thus is shaped like a deformed diamond extending to the front and rear. The second cam plate 23 has a moderately curved cam 27 at front and rear portions of its periphery with respect to the output shaft 17 as a center. At the upper and lower ends with respect to the output shaft 17 as a center, the second cam plate 23 also has push sections 28 formed continuously with the cam 27. The second cam plate 23 as a whole is shaped like a deformed diamond vertically elongate. The first and second cam plates 22 and 23 are rigidly secured to the output shaft 17 with the two cam plates about 90° out of phase from each other.

At lower portion of the gear case is rotatably and horizontally mounted a rotating shaft 29 which has a gear 30 secured at one end that is in mesh with the output gear 21 and at the other end a speed reduction gear 31.

Rotatably and horizontally supported at near the lower end of the frame 12 is a wheel shaft 32 which has a wheel 33 rigidly secured to the intermediate portion thereof. The wheel shaft 32 also has a drive gear 34 that is in mesh with the speed reduction gear 31. The output gear 21, rotating shaft 29, gear 30, speed reduction gear 31 and drive gear 34 are combined to form a gear mechanism 35. The wheel 33 is partly projected down from the ski member 2 through a guide slot 36 formed in the ski member 2 and is rotated in the guide slot 36.

Rotatably and horizontally mounted at an upper part of the gear case 16 is a rotating shaft 37 which has a brake gear 38 and a gear 39, both made of synthetic resin, the gear 39 being in mesh with the output gear 21 through a relay gear 40. In the gear case 16, an oscillation frame 42 made of synthetic resin, roughly U-shaped, is oscillatably supported on a support shaft 41. Side pieces 43 of the oscillation frame 42 have, at the lower ends on the inner sides, projections 44 facing each other with which the brake gear 38 comes into and out of engagement while turning. The rotating shaft 37, brake gear 38, gear 39, relay gear 40, and oscillating frame 42 with projections 44 are combined to form a brake mechanism 45 that controls the rotation of the output gear 21.

Shafts 46 are horizontally projected from each side of the frame 12. On these shafts 46 a first interlock plate 47 and a second interlock plate 48, both roughly diamond-shaped, are rotatably supported at the rear corner through insertion holes 49. The first interlock plate 47 has at the lower end corner a horizontally projecting engagement pin 50 that engages with the cam 25 and the push section 26 of the first cam plate 22. The first interlock plate 47 also has an interlock pin 51 horizontally projecting from the upper end corner thereof. The interlock pin 51 is rotatably inserted in a guide slot 53 in an interlock piece 52 that is formed integral with and projects downwardly, with a little forward inclination, from the mounting shaft 9 of the right arm 8. The second interlock plate 48 likewise has at the lower end corner a horizontally projecting engagement pin 54 that engages with the cam 27 and the push sections 28 of the second cam plate 23. At the upper end corner of the second interlock plate 48 an interlock pin 55 projects horizontally to be rotatably inserted in a guide slot 57 of an interlock piece 56. The interlock piece 56 is formed integral with and projects downwardly with a little backward inclination from the mounting shaft 9 of the left arm 8. Stretched between engagement portions 58, 58 at the front end corner of the first and second interlock plates 47 and 48 and projections 59, 59 at the lower portion of the frame 12 on each side are coil springs 60, 60 that keep the engagement pins 50, 54 in contact at all times with the cam 25 of the first cam plate 22 and with the cam 27 of the second cam plate 23, respectively.

The ski member 2 consists of parallel right and left skis **2*a*, 2*b* that are formed integral. The ski member 2 has its bottom shaped in arc to form a sliding surface 2*c* so that the toy can easily tilt right and left. At the center of the sliding surface 2*c* with respect to the widthwise direction, the guide slot 36 is formed in the ski member 2 to guide the wheel 33. The wheel 33 projecting partially from the sliding surface 2*c* through the guide slot 36 is rotatably mounted at the central lower portion of the body 3**.

Now, we will explain the operation of the toy with the above construction.

First, the thumb wheel 24 is rotated clockwise a desired number of turns by fingers. As the output shaft 17 is turned, the spring 18 on the shaft 17 is wound up and charged.

Figure 4:
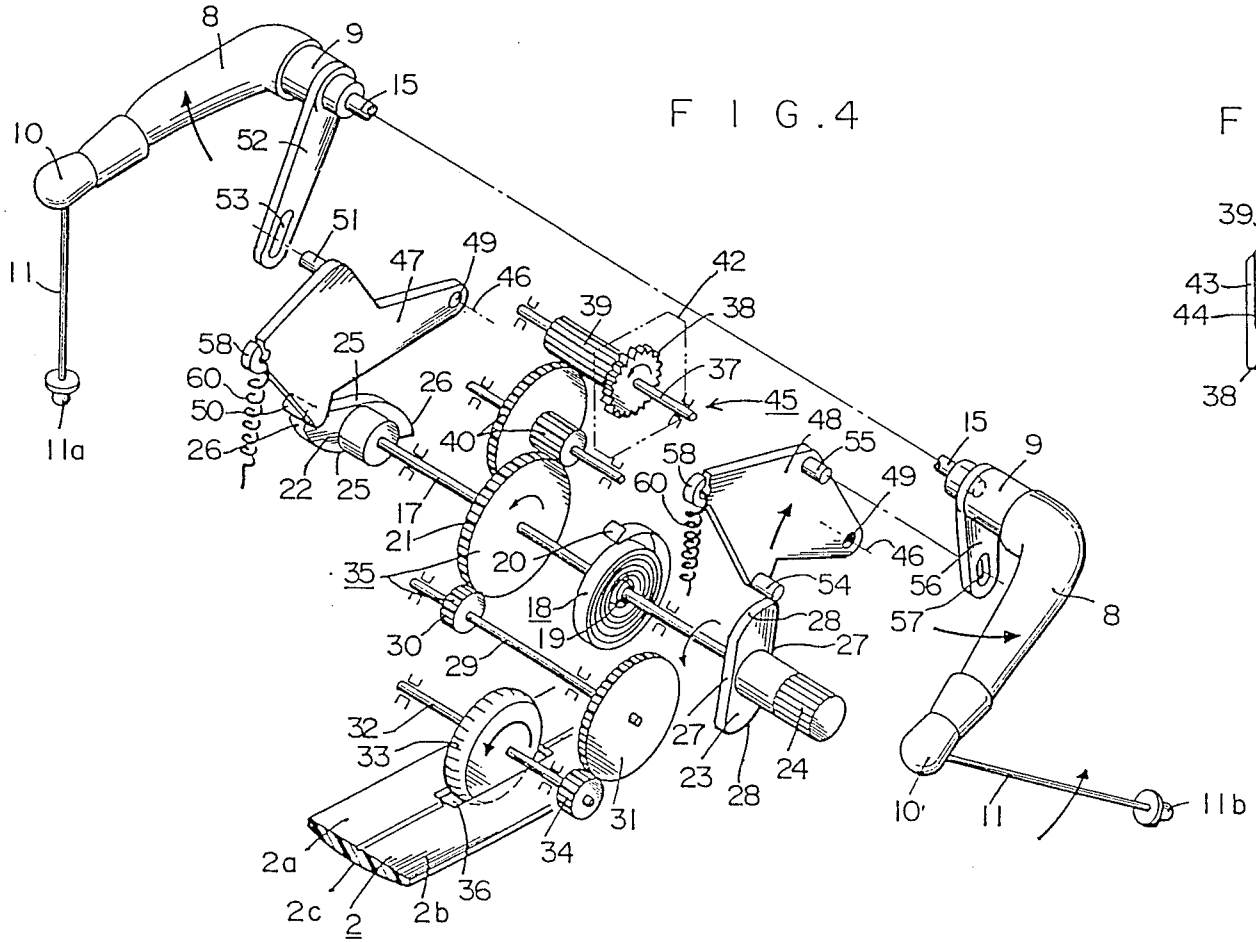
FIG. 4 is a perspective exploded view of the drive mechanism of the toy.

When, after the spring 18 is charged, the fingers are released from the thumb wheel 24, the spring 18 automatically unwinds rotating the output shaft 17, the output gear 21, and the first and second cam plates 22 and 23 in the direction indicated by arrow of FIG. 4.

The rotation of the output shaft 21 causes the gear 30, the speed reduction gear 31 and the drive gear 34 to turn, with the result that the wheel 33 on the shaft 32 rotates counterclockwise as indicated by a heavy arrow, causing the ski member 2 to slide forward.

At the same time that the wheel 33 turns, the first and second cam plates 22 and 23 also rotate. The push sections 26 of the cam 25 of the first cam plate 22 intermittently push up the engagement pin 50 of the first interlock plate 47 which in turn is intermittently oscillated vertically about the shaft 46 against the force of the coil spring 60. The oscillation of the first interlock plate 47 is transmitted through the interlock pin 51 and the interlock piece 52 to the right arm 8 which then is oscillated vertically about the shaft 15.

As the second cam plate 23 is rotated, the push sections 28 of the cam 27 intermittently push up the engagement pin 54 of the second interlock plate 48 which is intermittently oscillated vertically about the shaft 46 against the force of the spring 60. The oscillation of the second interlock plate 48 is transmitted through the interlock pin 55 and the interlock piece 56 to the left arm 8 which then is oscillated vertically about the shaft 15.

Because the first and second cam plates 22 and 23 are 90° out of phase and because the interlock pieces 52 and 56 on each side are slightly tilted forward and backward respectively, the right and left arms 8, 8 are alternately oscillated vertically and intermittently about the shafts 15, 15 and the poles 11, 11 on each side are alternately moved up and down with the arms 8, 8.

Figure 2:
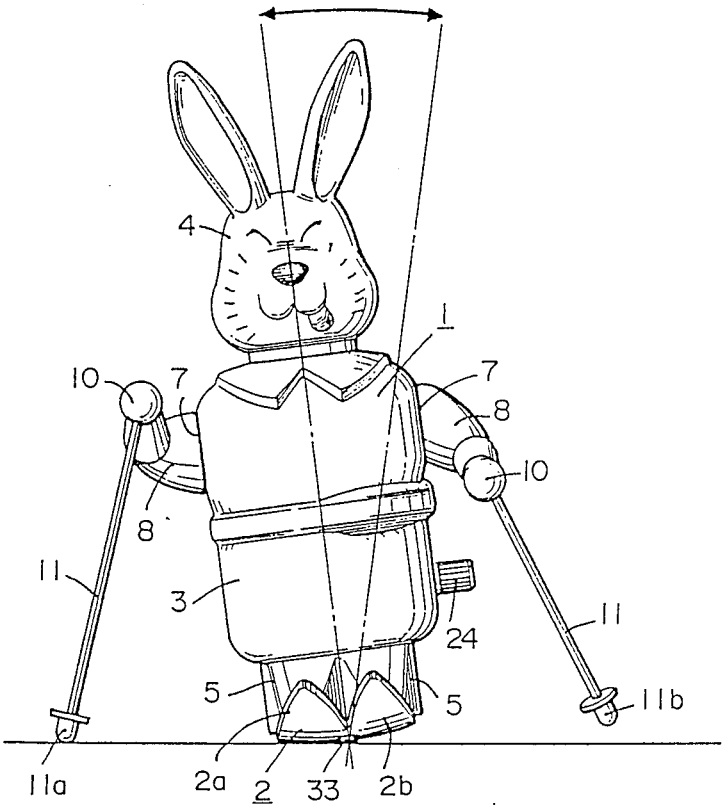
FIG. 2 is a front view of the toy.
Figure 3:
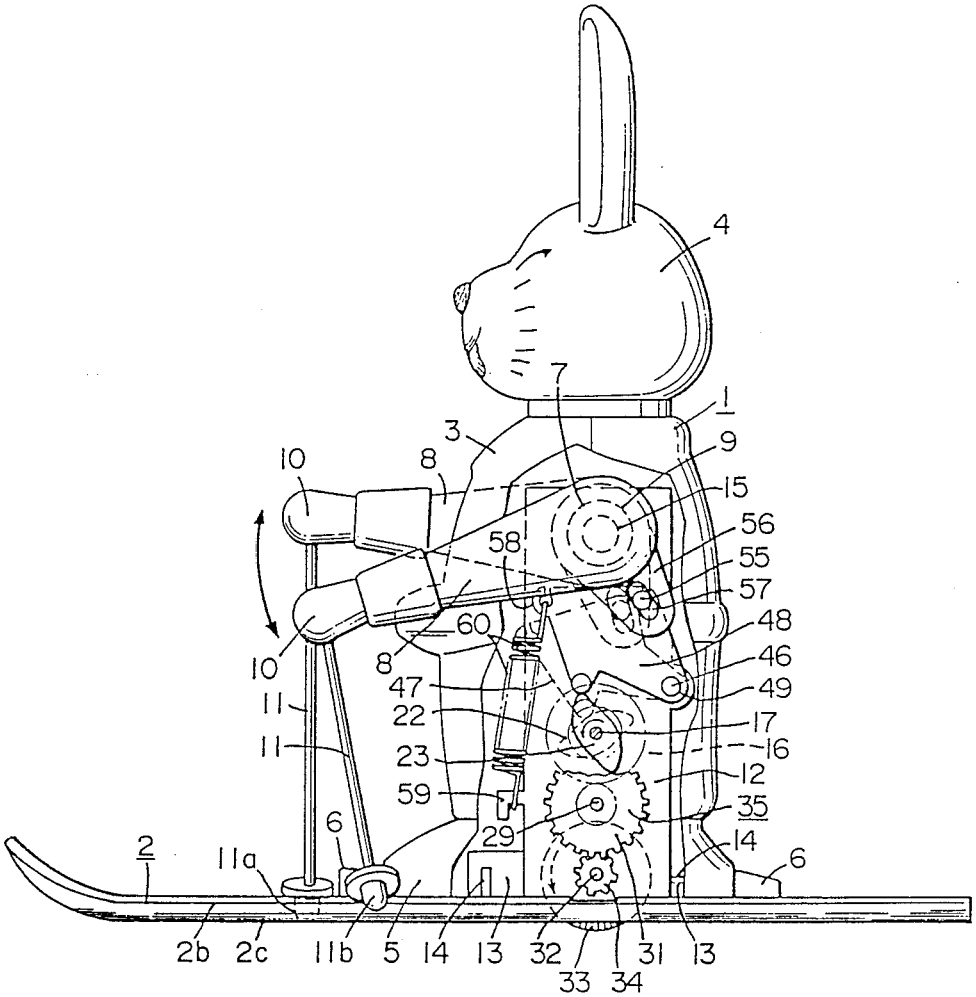
FIG. 3 is a side view of the toy partially cut away.
Figure 5:
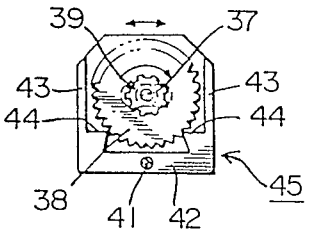
FIG. 5 is a side view of the brake mechanism.

When, with the front end **11*a* of the pole 11 on the right-hand side resting on the floor and the front end 11*b* of the pole 11 on the left-hand side lifted from the floor, the right arm 8 is oscillated upward and left arm 8 downward, the toy member 1 shifts its gravity center toward the right when viewed in the direction of advance, with the wheel 33 acting as a pivot center, as shown in FIG. 2. That is, the toy member 1 tilts toward the right arm 8 which was raised, resulting in the front end 11*a* of the pole 11 that was lifted coming into contact with the floor. Thus, the toy member 1 is supported by the pole 11** on the right-hand side.

Since the wheel 33 is rotatating, as the toy member 1 tilts to the right with respect to the moving direction together with the wheel 33 and ski member 2, the right-hand ski *2a* slides describing a curved trail toward the right.

Further, when the right arm 8 that was raised is moved down and the left arm 8 is raised, the toy member 1 tilts toward the left arm 8 that is being raised and is supported by the pole 11 on the left-hand side. The rotation of the wheel 33 while inclined causes the left-hand ski *2b* slide describing a curved trail toward the left.

Performing alternate vertical oscillations of the right and left arms 8, 8, the toy member 1 acts like a skier doing slalom making right and left turns by using the two poles 11, 11.

The output gear 21, which is driven by the charged spring 18 to rotate the gear 30, is partially restrained in its rotation by the brake mechanism 45, so that the output gear 21 is smoothly rotated at a constant speed. That is, when the output gear 21 is rotated, it turns the brake gear 38 through the relay gear 40 and the gear 39. Since the brake gear 38 comes into and out of contact with the front and back projections 44, 44 of the oscillation frame 42 that oscillates back and forth about the shaft 41 as the brake gear 38 is turned, the brake gear 38 is restrained in its rotation by the resistance of the projections 44, 44. This restraining force is transmitted through the gear 39 and the relay gear 40 to the output gear 21, which is then smoothly rotated at a constant speed without being driven irregularly according to the charging condition of the spring 18. This ensures the smooth slalom action of the toy member 1 at an almost constant speed.

Although in the above embodiment the toy member 1 is made in the likeness of a rabbit, this invention of course is applicable to any other kind of animal toys as long as they have right and left arms that can be oscillated up and down.

While this embodiment uses a spring as a source of driving force, it is also possible to use a motor in the driving mechanism.

[Effect of the Invention]

Since, according to this invention, the toy member is erected on the skis and driven by an output mechanism to alternately oscillate the right and left arms vertically and at the same time rotate the wheel, it is possile to provide a very interesting moving animal toy that acts as if it were doing slalom making serpentine turns by using two poles and edging the skis.

What is claimed is:

1. A moving animal toy comprising:

a ski member including parallel right and left skis formed into a single integral ski unit having a longitudinally extending bottom shaped transversely in the form of an arc, and a guide slot located in the transverse center of said ski member;

a toy member mounted on said ski member above said guide slot having right and left arms holding poles, said arms mounted on said toy member for alternate vertical oscillation relative to each other, a single wheel member rotatably mounted thereon to partially project through said guide slot, first and second cam plates rotatably mounted on said toy member, first and second interlock means connected between said first and second cam plates and said right and left arms respectively to alternately oscillate said right and left arms vertically between raised and lowered positions upon rotation of said cam plates, an output mechanism having a power output; and a gear mechanism installed in said toy member and connected to said power output to rotate said wheel member to move said toy member and said output mechanism simultaneously, rotates said cam plates to alternately oscillate said right and left arms resulting in alternate shifts in the center of gravity of the toy to cause it to tilt right and left with said wheel as a pivot center and make serpentine turns while moving.

2. A moving animal toy according to claim 1 wherein said first and second interlock means comprise:

first and second interlock plates, means for mounting each of said first and second interlock plates on said toy member for oscillation between arm raised and lowered positions, and a spring means connected to normally bias each of said interlock plates to one of said positions.

3. A moving animal toy according to claim 1 wherein said output mechanism includes an output shaft rotatably mounted on said toy member and a drive spring connected to and wound about said output shaft; and said first and second cam plates are mounted in spaced apart relation on said output shaft for rotation therewith.

4. A moving animal toy according to claim 2 wherein said output mechanism comprises an output shaft rotatably mounted on said toy member and a drive spring connected to and wound about said output shaft; and said first and second cam plates are mounted in spaced apart relation on said output shaft for rotation therewith.

5. A moving animal toy according to claim 1 wherein a brake mechanism is mounted in said toy member and connected to said output mechanism to regulate the rotation of said wheel member, said brake mechanism comprising a U-shaped oscillation frame including spaced apart side pieces each having an inner side, a support shaft on said toy member for pivotally supporting said oscillation frame;

and projections mounted on said inner sides of said oscillation frame in spaced apart facing relation to each other; and a brake gear rotatably mounted on said oscillation frame between said spaced apart projections and connected to be rotated by said-output mechanism, said rotation causing said oscillation frame to oscillate and alternately move said projections into and out of engagement with said brake gear.

6. The moving animal toy according to claim 1, wherein said first and second cam plates are 90° out of phase and when these cam plates are rotated together with said wheel, said right and left arms are alternately oscillated vertically and intermittently, causing said poles attached to the arms on each side to alternately move up and down.

* * * * *